US005540794A

United States Patent [19]

Willer et al.

[11] Patent Number: 5,540,794

[45] Date of Patent: Jul. 30, 1996

[54] ENERGETIC BINDER AND THERMOPLASTIC ELASTOMER-BASED LOW VULNERABILITY AMMUNITION GUN PROPELLANTS WITH IMPROVED MECHANICAL PROPERTIES

[75] Inventors: Rodney L. Willer; Dennis J. Park, both of Newark, Del.

[73] Assignee: Thiokol Corporation, Ogden, Utah

[21] Appl. No.: 880,191

[22] Filed: May 11, 1992

[51] Int. Cl.[6] ..... C06B 45/10

[52] U.S. Cl. ..... 149/19.8; 149/19.1; 149/100

[58] Field of Search ..... 149/19.1, 19.8, 149/96, 100

[56] References Cited

U.S. PATENT DOCUMENTS

| | | | |
|---|---|---|---|
| 3,956,890 | 5/1976 | Davis | 149/19.4 |
| 4,011,114 | 3/1977 | Allabashi | 149/19.8 |
| 4,216,039 | 8/1980 | Pierce | 149/19.8 |
| 4,284,442 | 8/1981 | Voigt | 149/19.4 |
| 4,288,262 | 9/1981 | Flanagan et al. | 149/19.1 |
| 4,325,759 | 4/1982 | Voigt et al. | 149/19.92 |
| 4,806,613 | 2/1989 | Wardle | 528/59 |
| 4,919,737 | 4/1990 | Biddle et al. | 149/19.5 |
| 4,973,658 | 11/1990 | Hoeschele | 528/308.7 |
| 4,976,794 | 12/1990 | Biddle et al. | 149/19.5 |
| 5,049,648 | 9/1991 | Hoeschele | 528/301 |
| 5,162,494 | 11/1992 | Willer et al. | 528/408 |
| 5,482,581 | 1/1996 | Urenovitch | 149/19.8 |

*Primary Examiner*—Edward A. Miller
*Attorney, Agent, or Firm*—Ronald L. Lyons; Madson & Metcalf

[57] ABSTRACT

An energetic binder system useful for making TPE-LOVA propellants and energetic composites comprises at least one thermoplastic elastomer, at least one plasticizer, and nitrocellulose.

19 Claims, No Drawings

ENERGETIC BINDER AND THERMOPLASTIC ELASTOMER-BASED LOW VULNERABILITY AMMUNITION GUN PROPELLANTS WITH IMPROVED MECHANICAL PROPERTIES

FIELD OF THE INVENTION

The present invention is directed to energetic materials including energetic binders, low vulnerability ammunition (LOVA) gun propellants, and energetic composites.

BACKGROUND OF THE INVENTION

A continuing objective in the design of gun propellants is to provide a gun propellant which is energetic when deliberately ignited, but which exhibits high resistance to accidental ignition from heat, flame, impact, friction, shock, and chemical action. Propellants possessing such resistance to accidental ignition are known as "low vulnerability ammunition" (LOVA) gun propellants.

Conventional LOVA gun propellants comprise a cured elastomeric binder, throughout which are dispersed particulates of high-energy material, particularly oxidizers. The elastomeric binder is generally a cured elastomer, i.e. thermoset, formed, for example, by the urethane reaction of a multi-functional prepolymer with a multifunctional isocyanate. Examples of such conventional propellants are described, for example, in U.S. Pat. Nos. 4,263,070 and 4,456,493, the disclosures of which are incorporated herein by reference. Generally, LOVA propellant grains are formed by extrusion at elevated temperatures whereat substantial curing takes place. Because the grains cure to some extent as they are being formed, control of extrusion conditions is difficult. If cured, LOVA propellant is unusable, it cannot be recycled, and burning the propellant is generally the only suitable disposal method.

Another type of LOVA propellant has a binder of cellulose acetate or a cellulose acetate derivative. An example of this type of propellant is described in U.S. Pat. No. 4,570,540, the disclosure of which is incorporated herein by reference. These types of LOVA propellants are solvent processed, a process which entails relatively long processing times and a large number of steps. Also, the use of solvent creates environmental problems.

Yet another type of LOVA propellant is formed from a thermoplastic elastomer and particulates of high energy oxidizers, e.g. cyclotetramethylene-tetra-nitramine (HMX), or cyclotrimethylenetrinitramine (RDX). Examples of this type of propellant are described in U.S. Pat. Nos. 4,919,737 and 4,976,794, the disclosures of which are incorporated herein by reference. Such propellants typically comprise between about 60 and about 85 wt. percent of high energy oxidizer particulates and between about 15 to about 40 wt. percent of a binder system which is plasticized or unplasticized block copolymer having at least one crystalline block and at least amorphous block, giving the block copolymer, thermoplastic elastomeric characteristics.

Thermoplastic elastomers have been previously used in propellants for rocket motors or the like, for example, as described in U.S. Pat. No. 4,361,526, the disclosure of which is incorporated herein by reference. Gun propellants, however, are considered to be a different art than rocket motor propellants. Rocket motor propellants typically contain a particulate metal fuel, e.g., particulate aluminum. Gun propellants, on the other hand, should be substantially free of any metal, and for that matter, should be generally free of any material which leaves a solid residue in the barrel of the gun upon burning. Gun propellants should also be substantially free of chlorine, which degrades the gun barrel.

Furthermore, rocket motor grains are typically formed in a different manner. Gun propellant grains typically take their shape from the extrusion process and must be sufficiently solid when leaving the extruder to retain their extruded shape. Material for rocket motor propellants may be extruded, but generally large rocket motors assume their shape from a mold, e.g., the rocket motor case; thus, after leaving an extruder or mixer, a propellant composition for a rocket motor should be free-flowing or at least moldable so as to be able to assume the shape of the large mold.

The conventional TPE-LOVA propellants have suffered from undesirably low mechanical properties. Prior efforts to utilize TPE-based propellants have been frustrated in part by an inability to prepare a material which exhibits low viscosity at mixing temperatures while having sufficient structural rigidity during potential propellant storage temperatures. Efforts to solve these and other problems have included decreasing the amount of plasticizer in the propellant. Although reducing the amount of plasticizer may impart certain useful high temperature mechanical properties, unfortunately it concurrently and undesirably reduces the propellants impetus by a significant amount. This is a significant drawback inasmuch as a combination of both high impetus coupled with desirable mechanical properties are critical to obtaining a successful LOVA propellant.

SUMMARY OF THE INVENTION

The present invention relates to an energetic binder which is useful for gun propellants and for various other energetic applications. In particular, improved TPE LOVA gun propellant ammunition is obtained when utilizing the present novel energetic binder system. Novel energetic composites are obtained using the present energetic binder system.

The energetic binder system comprises at least one thermoplastic elastomer, at least one plasticizer, and nitrocellulose, with the proviso that the thermoplastic elastomer component(s) comprise 33 wt. % to 90 wt. % of the binder system. This energetic binder system exhibits significantly improved mechanical properties while exhibiting satisfactory energy levels and burn rate characteristics.

The energetic binder system is easily synthesized, as distinguished from various previously known binder systems having energetic components attached to a polymeric backbone. The novel energetic binder system yields a desired combination of energy output coupled with unexpectedly good mechanical properties.

The novel energetic binder system offers the further advantage of recyclability. The binder may be re-heated, re-ground, and/or re-extruded as desired for re-use.

DETAILED DESCRIPTION OF THE INVENTION

The energetic binder system comprises at least one thermoplastic elastomer, at least one plasticizer, and nitrocellulose, with the proviso that the thermoplastic elastomer component comprises from about 33 wt. % to 90 wt. % of the energetic binder system.

Exemplary elastomers suitable for use as the thermoplastic elastomer component herein include polymers which are useful as a thermoplastic rubbery binder for high-energy oxidizer particles, such as tetra-methylene-tetra-nitramine (HMX) or trimethylenetrinitramine (RDX), for the preparation of low vulnerability gun propellants.

The thermoplastic elastomer component of the present binder system has at least one block which is amorphous at room temperature or lower, e.g. in the range of 20° C. to about 25° C. and preferably to at least −20° C. or lower, and at least one block which is crystalline at room temperature. It is generally necessary that in the block copolymer molecule, there is at least one pair of crystalline blocks flanking an amorphous block, whereby a thermoplastic network may be formed. The crystalline hard blocks preferably melt in a temperature range of between 70° C. and about 105° C. This temperature range allows processing at temperatures which do not decompose the binder components. At the same time, in this temperature range, the binder system retains the desired good mechanical properties at 63° C., generally considered to be the upper use temperature of LOVA gun propellants.

Various configurations of thermoplastic elastomers are suitable, including $(AB)_n$ polymers, ABA polymers, and $A_n$ B star polymers, wherein the A blocks flank at least one B block, allowing the crystalline A blocks to define a cross-linked structure at lower temperatures, while the amorphous B blocks give the polymer its elastomeric properties.

A diverse number of thermoplastic elastomers, including, for instance, polyoxetanes, mixed polyesters, polyester-polyethers, and polyamide-polyethers, may be used in the present binder system. ABA polymers such as those based on, for instance, polyoxetanes and poly(oxetanes/tetrahydrofuran) copolymers are useful. Illustrative suitable $(AB)_n$ polymers include those based on polyoxetanes and poly(oxetane/tetrahydrofuran) copolymers, such as, for instance, thermoplastic elastomers having A blocks and at least one B block, wherein the A blocks are crystalline at temperatures below about 60° C. and the B block(s) is amorphous at temperatures above about −20° C., the A blocks are polyethers derived from monomers of oxetane and its derivatives and/or tetrahydrofuran and its derivatives. Additional exemplary and suitable thermoplastic elastomers are described in U.S. Pat. No. 4,806,613, the disclosure of which is incorporated herein by reference.

Exemplary suitable polymers also include various co-polyesters, such as, for instance, segmented thermoplastic copolyester elastomers consisting essentially of a multiplicity of recurring intralinear long chain, i.e. amorphous, and short chain ester units, i.e. crystalline, connected head-to-tail through ester linkages. The long chain ester units in such co-polyesters are preferably somewhat polar. Illustrative long chain ester units are represented by a structure selected from the among the following:

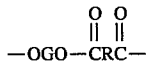

and

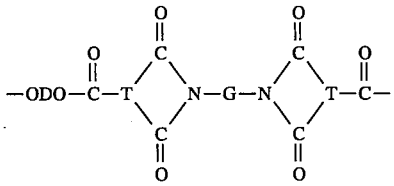

The short chain ester units in such exemplary copolyesters include those represented by the following:

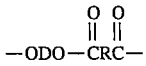

wherein G is a divalent radical remaining after removal of terminal hydroxyl groups from a poly(alkylene oxide) glycol having a carbon-to-oxygen ratio of about 2.0–4.3 and a molecular weight of about 600–6000; R is a divalent radical remaining after removal of carboxyl groups from a dicarboxylic acid having a molecular weight less than about 300; D is a divalent radical remaining after removal of hydroxyl groups from a linear diol having 2–8 carbon atoms and represented by the formula $HO(CH_2)_{2-8}OH$ or the diol $HO(CH_2CH{=}CHCH_2{-})OH$; and T is a trivalent radical remaining after the removal of carboxyl groups from a tricarboxylic acid having a molecular weight less than about 350 and containing two vicinal carboxyl groups capable of forming a cyclic imide; with the proviso that the short chain ester units constitute about 30–65% by weight of the copolyester, at least about 50% of the R groups are 1,4-phenylene radicals, at least about 50% of the D groups are 1,6-hexamethylene radicals, and the sum of the percentages of the R groups which are not 1,4-phenylene radicals and of the D groups which are not 1,6-hexamethylene radicals is about 5–50%. For use as a propellant binder it is preferred that the copolyester have a melt index at 120° C. by ASTM-D1238 of about 2–25 grams/10 minutes.

Another exemplary suitable copolyester having both long chain and short chain ester units is one that includes, for instance, long chain ester units being represented by:

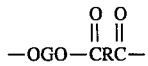

and the short chain ester units represented by the structure:

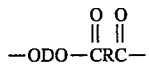

wherein G is a divalent radical remaining after removal of terminal hydroxyl groups from a poly(alkylene oxide) glycol; R is a divalent radical remaining after the removal of carboxyl groups from a dicarboxylic acid; and D is a divalent remaining after removal of hydroxyl groups from a low molecular weight diol; with the proviso that the short chain ester units constitute about 25–65% by weight of the copolyester, at least about 75% of the R groups are 1,3-phenylene radicals, at least about 75% of the D groups are 1,4-butylene radicals, and the sum of the percentages of the R groups which are not 1,3-phenylene radicals and the D groups which are not 1,4-butylene radicals cannot exceed about 25%. These exemplary suitable copolyesters are further characterized by a melt index at 120° C. (ASTM D1238) of about 2–25 gram/10 minutes.

Additional thermoplastic elastomers and their methods of preparation are described in U.S. Pat. No. 5,049,648 and U.S. Pat. No. 4,973,658, the disclosures of which are incorporated by reference.

Illustrative hard blocks include polybutylene terephthalate and polyhexylene terephthalate, and examples of soft blocks include poly(ethylene glycol) and poly (THF).

Commercially available and suitable thermoplastic elastomers are sold by DuPont under the trade names LRG-291, LRG-299, LRG-300, LRG-322, LRG-323, and LRG-326.

Other specific thermoplastic elastomers include polyethylene succinate/poly diethylene glycol adipate (PES/PEDGA) block polymers, as well as copolyethers such as, for example, poly 3,3-disubstituted oxetanes. Co-polyethers are described in U.S. Pat. No. 4,976,794, the disclosure of which is incorporated herein by reference.

The binder system contains at least one suitable thermoplastic elastomer, and, if desired, may include more than one such elastomer.

The novel energetic binder system contains at least one plasticizer. The plasticizer component will comprise, depending on the end-use of binder, about 5 to about 40 wt. % if desired, 5 to 33½ wt. %, of binder. Good results in LOVA applications have been obtained at 25 wt. %. The plasticizer can be energetic, non-energetic, or combinations of plasticizers. Thus, for instance, an energetic plasticizer may used singly, or in combination with non-energetic plasticizers, or in combination with another energetic plasticizer.

Illustrative suitable such plasticizers include, for example, butanetriol trinitrate (BTTN), trimethylolethane trinitrate (TMETN), a mixture of bis (2,2-dinitropropyl) formal and 2,2,8,8-tetranitro-4,6-dioxadecane and bis-(2,2-dinitrobutyl formal, triethylene glycol dinitrate, dibutoxyethyl phthalate, dibutoxyethyl adipate, chlorinated paraffin, methyl abietate, methyl dihydro-abietate, N-ethyl-o and p-toluene sulfonamide, polypropylene glycol sebacate, dipropylene glycol dibenzoate, di(2-ethylhexyl) phthalate, 2-ethylhexyldiphenyl phosphate, tri(2-ethyl-hexyl) phosphate, di(2-ethylhexyl) sebacate, santicizer 409 polyester by Monsanto, tetraethylene glycol-di(2-ethyl hexoate), dibutoxyethoxyethyl adipate, N,N-dimethyl oleamide, dibutoxyethyl azelate, dioctyl azelate, dibutoxyethoxyethyl glutarate, dibutoxyethyl glutarate, polyethylene glycol 400 dilaurate, polyethylene glycol 400 dioleate, dibutoxyethoxyethyl sebacate, dibutoxyethyl sebacate, n-butyl-2-nitratoethyl-nitramine, ethyl-2-nitratoethyl-nitramine, eutectic blends of n-butyl-2-nitratoethyl-nitramine and methyl-2-nitratoethylnitramine, eutectic blends of ethyl-2-nitratoethyl-nitramine (42 wt. %) and methyl-2-nitratoethylnitramine (58 wt %), and trioctyl trimellitate.

The energetic binder system further contains an effective amount of nitrocellulose. An effective amount of nitrocellulose will be depend on compositional context in which the present binder is used and may range from about 5 to about 40 wt. %, or, if desired, 5 to 33½ wt. % of the binder. Good results have been obtained in LOVA applications at 25 wt. %. Although the amount of nitrocellulose will typically vary, independently of the plasticizer, within such range, equal wt. % of the plasticizer and nitrocellulose are useful in certain applications. Nitrocellulose will typically include at least one stabilizer.

Advantageously, the energetic binder system is preferably essentially halogen-free and, particularly essentially chlorine-free, and is essentially metal-free.

The novel binder is an essential component of certain novel TPE-LOVA propellants. The novel TPE-LOVA propellants according to the present invention exhibit unexpectedly good mechanical properties, and, surprisingly, less than 2% creep. Typically, these TPE-LOVA propellants will show less than 1% creep. Further, with these TPE-LOVA propellants excellent fracture resistance is retained even at temperatures as low as −21° C. These TPE-LOVA propellants also possess sufficiently low viscosity at mixing temperatures, while also having the desired structural rigidity during extrusion and across the range of expected storage temperatures.

Exemplary novel TPE-LOVA propellants comprise 60–85 wt. % o of a high-energy oxidizer dispersed in the energetic binder system which, in turn, may comprise 10–38 wt. % of at least one thermoplastic elastomer, 1–13% of at least one plasticizer, and 1–13% of nitrocellulose (wt. % of propellant). In addition to the binder system and oxidizer particulates, the TPE-LOVA formulation may include processing aids, lubricants, colorants or the like. Preferably, the high-energy oxidizer particulates are tetramethylenetetranitramine (HMX), trimethylenetrinitramine (RDX) or a mixture thereof.

These TPE-LOVA propellants according to the present invention are obtainable by admixing the novel energetic binder system, as heretofore described, with a high-energy oxidizer, such as, for instance RDX, HMX or a combination of HMX and RDX. The binder system is in the melt form. Preferably, the oxidizer component is in the form of fine particulates. For example, in one embodiment, an RDX oxidizer to be added was divided into two portions based on average particulate sizes into order to facilitate its addition to the melt. Advantageously, for example, in such embodiment the RDX particle sizes in one portion averaged 2μ and in the other 5μ.

The solids content of these TPE-LOVA propellants may range from 70 to about 85 percent. Preferably, the solids content is from about 75–76 percent to about 82 percent.

The novel TPE-LOVA propellant compositions are blended at temperatures ranging from, for instance, about 80° C. to about 120° C. in a mixing apparatus, such as a twin screw extruder or the like. Once extruded, the mix is cut, and/or chipped into the pre-selected sized shapes. Suitable shapes and processing techniques are mentioned in U.S. Pat. No. 4,919,737.

Elevated temperature compressibility and slump of certain LRG-based TPE-LOVA propellant compositions according to the present invention have been examined. The extruded TPE-LOVA propellants based on the LRG polymers (DuPont) have been examined for elevated-temperature mechanical properties by the application of a static force upon a cylindrical sample maintained at 63° C. These compositions had an initial compression under load (5 psi) of from 1.7 to 3.6%, depending upon the LRG polymer. The longer term compression or slump at 63° C. of these extruded materials ranged from 0.3 to 2.54 percent, depending upon the LRG polymer. This compares favorably with the value of 0.89% for initial compression and 0.12% for slump for a typical "CAB" based LOVA propellant. The addition of energetic plasticizer increased this initial compression by various degrees, depending upon the LRG-to-plasticizer/nitrocellulose ratio. The LRG-299 polymer exhibited the least response to increasing plasticizer level, while the LRG-326 yielded the greatest response. In order of increasing initial compression, the binder systems (with plasticizer) may be roughly ranked based on the elastomeric component as follows: LRG-299, LRG-291, LRG-323, LRG-322, LRG-300, and LRG-326.

The slump characteristics of the novel binder system may be moderated and thus controlled by selecting the amount of plasticizer to be added and/or the specific thermoplastic elastomer(s). For example, a balance of binder properties wherein slump values are decreased, or increased, is attained by selecting the appropriate thermoplastic elastomer component. The LRG-299 polymer again exhibited the least response to increasing plasticizer level, while the LRG-326 yielded the greatest response. In the properties balancing, and relative to increasing elevated temperature and increased slump, binders would be ranked, for instance, in the order of the thermoplastic elastomer component as follows: LRG 299, LRG 322, LRG 291, LRG 323, LRG 300, and LRG 326.

The novel binder system is also useful in formulating novel energetic composite compositions. An exemplary composite propellant comprises (A) at least one oxidizer, in fine particulate form, (B) dispersed in an energetic binder system comprising at least one thermoplastic elastomer, at least one plasticizer and nitrocellulose, wherein the thermoplastic elastomer comprises 33–90 wt. % of the energetic binder system component in the composite, (C) a fuel material, and, if desired, (D) a burn rate modifier. The oxidizer may be inorganic, and illustrative oxidizers include 75–80 wt. % ammonium nitrate, 80–85 wt. % ammonium perchlorate, and 75–85 wt. % of a mixture of ammonium nitrate and ammonium perchlorate, the wt. % being relative to the composite. Advantageously, the fuel will be a powdered metal, and aluminum is preferred. Burn rate modifiers include, for instance, ferric oxide. In this embodiment, the plasticizer may be present in an amount of 5 to 40 wt. % of the binder, and the nitrocellose may be present in an amount of 5 to 40 wt. % of the binder, although good results have been obtained when such components have been used in amounts in the range of from about 5 wt. % to about 30 wt. %.

Advantageously, during preparation of the composite, powdered aluminum and the burn rate modifier are first mixed with and coated with the energetic binder prior to their admixture with the oxidizer constituent. Lump formation during processing is undesired. Accordingly, for processing reasons, when the oxidizer constituent is to be blended with the coated components, the oxidizer may be added in selected amounts as long as the total effective amount of the oxidizer constituent is present in the final composite composition. Thus, for instance, during processing the oxidizer constituent may be divided into differing amounts to be added, and such amounts to be added may be further differentiated based on the average particle sizes, such as a portion having particulates averaging about 18 microns and another averaging about 1.4 microns.

EXAMPLES

The following non-limiting examples describe the invention in greater detail.

Example 1

To make a gumstock at a $Po/P_1$, ratio of about 1:1, LRG-299 (10.66 grams) was placed in a 100 ml flask and dissolved in 300 ml of methylene chloride. Nitrocellulose (6.47 grams) having a rated viscosity of 18–24 cps. was dissolved in 100 ml of acetone. The two prepared solutions were combined by pouring the nitrocellulose/acetone solution into the gumstock solution while vigorously stirring until homogeneous, whereupon BTTN/TMETN (3.51 grams of 2:1 mixture) was added and vigorously stirred until again homogeneous. The homogeneous solution was poured into a teflon coated pan and placed in an air draft hood and the solvents were allowed to evaporate.

Example 2

To make a gumstock at a $Po/P_1$ ratio of 2:1, LRG-299 (13.76 grams) was placed in a 1000 ml flask and dissolved in 300 ml of methylene chloride. In a separate beaker nitrocellulose (3.44 grams) having a rated viscosity of 18–24 cps was dissolved in 100 ml of acetone. When completed, the nitrocellulose in acetone solution was poured into the flask containing the LRG-299 gumstock in methylene chloride. The resultant mixture was vigorously stirred until homogeneous. Then BTTN/TMETN (3.44 grams; 2:1 mixture) was then added to the mixture while vigorously stirring until the admixture was again homogeneous. The composition was poured into a teflon coated pan and placed in a air draft hood and the solvents were allowed to evaporate.

Example 3

To make a gumstock at a $Po/P_1$ ratio of 4:1, LRG-299 (16.51 grams) was placed in a 1000 ml flask and dissolved in 300 mls of methylene chloride. In a separate beaker, nitrocellulose (2.07 grams), having a rated viscosity of 18–24 cps, was dissolved in about 100 mls. of acetone. When the respective solutions were complete, the nitro cellulose in acetone solution were poured into the flask containing LRG-299 gumstock in methylene chloride. The resultant mixture was stirred vigorously until homogeneous, whereupon BTTN/TMETN (2.06 grams; 2:1 ratio) was added, and vigorous stirring was continued until the mixture was again homogeneous. The thus obtained composition was poured into a teflon coated pan, placed in an air draft hood, and the solvents are allowed to evaporate.

Example 4

To make a gumstock at a $Po/P_1$ ratio of 9:1, LRG-300 (90 grams) was placed in a 1000 ml flask and dissolved in 300 ml methylene chloride. In a separate beaker nitrocellulose (5 grams) having a vendor rated viscosity of 18–24 cps was dissolved in about 100 ml of acetone. When the respective solutions were complete, the nitrocellulose in acetone solution was poured into the flask continuing the LRG-299 gumstock in methylene chloride. The resultant mixture is vigorously stirred until homogeneous. Then BTTN/TMETN (5 grams; 2:1 mixture) was added to the flask and vigorously stirred until the mixture was again homogeneous. The composition was poured into a teflon pan and placed in a air draft hood and the solvents were allowed to evaporate.

Examples 5–10

Various energetic binders according to the present invention, at varying $P_0/P_1$ ratios, using different designated thermoplastic elastomers were made in accordance with the respective corresponding $P_0/P_1$ product of Example 1,2, 3, or 4. These binders are identified in Table 1.

Example 11

To make 100 g of gumstock at a $P_0/P_1$ ratio of 2:1, LRG-299 (50 grams) was placed in a 1000 ml flask and dissolved in 300 ml of methylene chloride. In a separate beaker nitrocellulose (25 grams) having a rated viscosity of 18–24 cps was dissolved in 100 ml of acetone. When completed, the nitrocellulose in acetone solution was poured into the flask containing the LRG-299 gumstock in methylene chloride. The resultant mixture was vigorously stirred until homogeneous. Then a mixture of bis-(2,2-dinitropropyl) formal, bis-(2,2-dinitrobutyl) formal and 2,2,8,8-tetranitro-4,6-dioxadecane (25 grams, 60:35:5 ratio) was then added to the mixture while vigorously stirring until the admixture was again homogeneous. The composition was poured into a teflon coated pan and placed in a air draft hood and the solvents were allowed to evaporate.

The dried products of Examples 1–11 were recovered, and flat sheets of the binders were prepared using a heated hydraulic press at 200° F. ASTM tensiles were stamped from the sheets and tested on an Instron Model 1125 Universal Testing machine at a rate of 10 in/min at 77° F.

Table 1 summarizes the results obtained using the energetic binder system of Examples 1–11.

TABLE 1

| LRG | Po/$P_1$ | TMA, °C. | Stress, psi 50% | Stress, psi Rupture | Strain, % |
|---|---|---|---|---|---|
| 291 | 4:1 | 86 | 333 | 1709 | 560 |
| 291 | 2:1 | 78 | 156 | 492 | 600 |
| 299 | 1:1 | 71 | — | 83** | 587 |
| 299 | 2:1 | 92 | 595 | 1076 | 550 |
| 299 | 9:1 | 83 | 305 | 751 | 460 |
| 300 | 9:1 | 111 | 259 | 956 | 760 |
| 300 | 4:1 | 107 | 213 | 793 | 810 |
| 300 | 2:1 | 98 | 139 | 389 | 950 |
| 323 | 4:1 | 91 | 230 | 577 | 483 |
| 323 | 2:1 | 81 | 150 | 310 | 433 |
| 299* | 2:1 | 89 | 379 | 827 | 413 |

*designates a binder using a mixture of bis (2,2-dintropropyl) formal, 2,2,8,8-tetranitro-4,6-dioxadecane, and bis-(2,2-dinitrobutyl) formal as the plasticizer.
**The data as initially reported was in error.

Comparative Examples

Standard energetic binders were prepared. The standard energetic binders did not include nitrocellulose.

To make 100g of standard gumstock with a $P_0/P_1$ ratio of 4:1, LPG-299 (80 grams) was dissolved in 300 ml of methylene chloride in a 500 ml flask. When the solution was homogeneous, BTTN/TMETN (20 grams; 2:1 mixture) was added to the flask while vigorously stirring until the mixture was homogeneous. The composition was poured into a teflon coated pan and placed in an air draft hood and the solvent was evaporated off.

In a manner similar to Examples 1–4, additional standard binders were prepared. These nitrocellulose-free standard binders had the $P_0/P_1$, ratios reported in Table 2.

The softening temperature of gumstock (binder) samples was measured as the extrapolated deflection point on the dimension change versus temperature plot of a sample being heated at a constant heating rate. A nominal 1 mm thick by 6 mm square or round gumstock sample is placed on the quartz stage of a DuPont Model 943 Thermomechanical Analyzer (TMA) in direct contact with the sample thermocouple. The sample was covered with an aluminum disc (DSC pan lid) and a quartz micro-expansion probe brought into direct contact with the disc. A 10 gram load was applied to the probe and the sample was heated at a rate of 5° C. per minute from ambient to above the softening temperature. The resultant plot of probe displacement versus sample temperature was analyzed to define the deflection temperature (extrapolated) without regard for the quantitative magnitude of the dimension change.

The mechanical properties reported in the Examples (or Tables) were determined by stamping out ASTM class C dog bones from the binder sheets. These test specimens were tested in accordance with ASTM D412 at 10 inches per minute.

The results using a standard energetic binder system according to the comparative Examples are summarized in Table 2.

TABLE 2

STANDARD LRG BINDER PROPERTIES

| LRG | Po/$P_1$ | TMA, °C. | Stress, psi 50% | Stress, psi Rupture | Strain, % |
|---|---|---|---|---|---|
| 291 | 4:1 | 70 | 215 | 376 | 227 |
| 291 | 2:1 | 67 | — | 213 | 105 |
| 299 | 4:1 | 84 | 504 | 675 | 173 |
| 299 | 2:1 | 80 | 353 | 553 | 146 |
| 300 | 9:1 | 83 | 243 | 537 | 616 |
| 300 | 4:1 | 80 | 193 | 274 | 190 |
| 300 | 2:1 | 77 | 98 | 127 | 139 |
| 323 | 4:1 | 83 | 239 | 393 | 223 |
| 323 | 2:1 | 68 | 136 | 245 | 207 |
| 299* | 2:1 | 88 | 366 | 451 | 112 |

*designates a standard binder using a mixture of bis (2,2-dintropropyl) formal, 2,2,8,8-tetranitro-4,6-dioxadecane, and bis-(2,2-dinitrobutyl) formal as the plasticizer.

Example 12

TPE-LOVA propellants according to the present invention were prepared by mixing RDX with binders according to the present invention.

The binder was melted and mixed with RDX. The RDX was split into two portions (2μ-avg. particle size, 18.67 grams; 5μ-avg. particle size, 46.69 grams) and, each such portion was further split into smaller portions. The smaller portions were added, alternatingly, to the binder melt.

RDX-containing TPE-LOVA propellants were prepared using these binder systems:

1. LRG-299-based binder, LRG-299 ($P_0/P_1$, =1.07:1, 10.66 grams), BTTN/TMETN (2:1 ratio, 3.51 grams) and nitrocellulose (6.47 grams).
2. LRG-299 ($P_0/P_1$=1:0, 10.32 grams), BTTN/TMETN (2:1 ratio, 5.16 grams) and nitrocellulose (5.16 grams).
3. A series of LRG ($P_0/P_1$-2:1) binders were prepared based on: LRG (13.76 grams), BTTN/TMETN (2:1, 3.44 grams) and nitrocellulose (3.44 grams). In these four binders, the respective elastomeric thermoplastic components were: LRG-291, LRG-299, LRG-300 and LRG-323.
4. A series of LRG ($P_0/P_1$)=4:1) binders were prepared based on LRG (16.51 grams), BTTN/TMETN (2:1, 2.07 grams), and nitrocellulose (2.06 grams). In these four binders, the respective elastomeric thermoplastic components were: LRG-291, LRG-299, LRG-300 and LRG-323.
5. LRG-299 based binder, LRG-299 ($P_0/P_1$=2:1; 13.76 grams), a mixture of bis-(2,2-dinitropropyl) formal, bis-(2,2-dinitrobutyl) formal and 2,2,8,8-tetranitro-4,6-dioxadecane (60:35:5 ratio; 3.44 grams), and nitrocellulose (3.44 grams).
6. LRG-299 based binder, LRG-299 ($P_0/P_1$=1:1, 10.32 grams), a mixture of bis-(2,2-dinitropropyl) formal, bis-(2,2-dinitrobutyl) formal and 2,2,8,8-tetranitro-4,6-dioxadecane (60:35:5 ratio; 5.16 grams), and nitrocellulose (5.16 grams).

The thus prepared TPE-LOVA propellants exhibited significant and unexpected enhancement in properties across a spectrum of properties such as maximum stress and strain % compared to TPE-LOVA propellants made from comparable non-nitrocellulose containing standard energetic binders. A similar series of propellants were produced using the same procedures but which contained the standard nitrocellulose-free binders. The mechanical properties of the types of TPE-LOVA propellants were compared, and the results are summarized in Table 3.

The TPE-LOVA propellants of the present invention, reported in Table 3, were compression tested at 20 in/min at 75° F. on a screw driven Instron. The specimens were approximately 0.375 inches tall and 0.250 inches in diameter resulting in a L/D ratio of 1.5. The specimens were compressed 0.13 inches which was well past the compression necessary for maximum stress and strain. Stress and strain measurements were calculated from an oscilloscope trace of the load-time curve.

The stress and strain categories of the TPE-LOVA propellants are reported in Table 3. The stress varied from 422 to 1795 psi and the strain from 14.9 to 25.8 percent.

Ballistic characteristics of these TPE-LOVA propellants were compared with standard nitrocellulose-free TPE-LOVA propellants. The TPE-LOVA propellants according to the present invention exhibited an unexpected favorable balance of mechanical properties and retained the desired and satisfactory propellant impetus, whereas the same was not the case for TPE-LOVA propellants based on the standard nitrocellulose-free binder system. Results are summarized in Table 4 and Table 4A.

Unless otherwise stated, the TPE-LOVA propellants listed in Tables 3, 4 and 4A used BTTN/TMETN as the plasticizer.

TABLE 3

| Standard Propellant | | | | Propellant with Nitrocellulose | |
|---|---|---|---|---|---|
| Binder | | Max Press, | Strain | Max Stress, | Strain |
| LRG | Po/Pl | psi | % | psi | % |
| 291 | 4:1 | 850 | 15.9 | 1490 | 20.8 |
| | 2:1 | 610 | 16.1 | 1285 | 19.8 |
| | 1:1 | — | — | 1790 | 19.1 |
| 299 | 4:1 | 1010 | 14.9 | 1795 | 20.1 |
| | 2:1 | 642 | 17.2 | 1565 | 19.2 |
| 300 | 9:1 | 823 | 15.5 | — | — |
| | 4:1 | 770 | 17.5 | 1280 | 21.1 |
| | 2:1 | 370 | 16.2 | 1190 | 21.4 |
| 323 | 4:1 | 650 | 16.4 | 849 | 25.8 |
| | 2:1 | 422 | 18.6 | 839 | 21.1 |

TABLE 4

| Binder Po/Pl | | Standard Burn rate in./sec | | Present Invention Burn rate in. /sec | |
|---|---|---|---|---|---|
| LRG | Ratio | 11 kps: | 26 kps: | 11 kps: | 26 kps: |
| 291 | 9:1 | 1.11 | 3.55 | — | |
| 291 | 4:1 | 1.23 | 4.27 | 1.24 | 3.68 |
| 291 | 2:1 | 1.53 | 4.83 | 1.42 | 4.04 |
| 299 | 9:1 | 1.19 | 4.08 | — | — |
| 299 | 4:1 | 1.32 | 4.19 | 1.15 | 3.32 |
| 299 | 2:1 | 1.55 | 4.97 | 1.32 | 3.80 |
| 300 | 9:1 | 1.15 | 3.71 | — | — |
| 300 | 4:1 | 1.29 | 4.36 | 1.18 | 3.44 |
| 300 | 2:1 | 1.57 | 4.91 | 1.74 | 3.80 |
| 323 | 9:1 | 1.05 | 3.52 | — | — |
| 323 | 4:1 | 1.23 | 4.13 | 1.20 | 3.36 |
| 323 | 2:1 | 1.48 | 4.98 | 1.36 | 3.81 |

TABLE 4A

| Binder Po/Pl | | Standard | Present Invention |
|---|---|---|---|
| LRG | Ratio | Impetus J/g | Impetus J/g |
| 291 | 9:1 | 1058 | — |
| 291 | 4:1 | 1108 | 1097 |
| 291 | 2:1 | 1170 | 1153 |
| 299 | 9:1 | 1047 | — |
| 299 | 4:1 | 1099 | 1088 |
| 299 | 2:1 | 1163 | 1147 |
| 300 | 9:1 | 1034 | — |
| 300 | 4:1 | 1087 | 1077 |
| 300 | 2:1 | 1153 | 1137 |
| 323 | 9:1 | 1076 | — |
| 323 | 4:1 | 1124 | 1114 |
| 323 | 2:1 | 1184 | 1167 |

Example 13

In a mixing bowl at 250° F. under nitrogen atmosphere, an energetic composite (300 grams) was prepared.

Powdered aluminum (5 wt. %, 15.0 grams, 30 microns average particle size) and a burn rate modifier, ferric oxide (2 wt % 6 0 grams), were admixed with and coated with an energetic binder (15.55 wt %, 46.65 grams). The energetic binder comprised LRG-299 (50 wt. %), a mixture of bis-(2,2-dinitropropyl) formal, bis-(2,2-dinitrobutyl) formal and 2,2,8,8-tetranitro-4,6-dioxadecane (60:35:5 ratio; 30 wt. %) and nitrocellulose (20 wt. %). Thereafter ammonium perchlorate (43.1 wt. % 18μ average particle size, and 33.9 wt. % 1.4μ average particle size) was added in several small portions. When approximately half of the ammonium perchlorate had been added, lecithin (0.45%, 1.35 grams was added. The composite was recovered. The final viscosity was 270 kp.

Example 13

Following the procedure of Example 12, another composite was prepared in which the energetic binder therein comprised LRG-326 (50 wt. %), a mixture of bis-(2,2-dinitropropyl) formal, bis-(2,2-dinitrobutyl) formal and 2,2,8,8-tetranitro- 4,6-dioxadecane 60:35:5 ratio; 25 wt. % and nitrocellulose (25 wt. %).

This composite (302 grams) included 15.55 wt. % of the energetic binder, 2.0 wt. % of $Fe_2O_3$, 5.0 wt. % of powdered aluminum (30μ average particle size), 43.1 wt. % of ammonium perchlorate (18μ average particle size), 33.9 wt. % ammonium perchlorate (1.4μ average particle size) and lecitin (0.45 wt. %, 1.35 grams).

The composites of Examples 13 and 14 were hand packed into phenolic tubes.

The composites of Examples 12 and 13 are easily extruded into various geometries using a ram extruder at a barrel temperature of 107° C. and at a die temperature of about 100° C.

What we claim is:

1. An energetic binder system comprising at least one thermoplastic elastomer, plasticizer and nitrocellulose, wherein said thermoplastic elastomer comprises from 33 wt % to 90 wt % of said energetic binder system, said thermoplastic elastomer having at least one block which is amorphous in the temperature range of about 25° C. to at least −20° C., and at least one block which is crystalline at in a temperature range of about 20° C. to about 25° C.

2. An energetic binder system according to claim 1, wherein said binder contains from 5 to 33½ wt % of said plasticizer.

3. An energetic binder system according to claim 1, wherein said binder the nitrocellulose is present in an amount of from 5 to 33½ wt. %.

4. An energetic binder system according to claim 1, wherein said binder contains equal wt. % of said plasticizer and nitrocellulose.

5. An energetic binder system according to claim 1, wherein said plasticizer is energetic.

6. An energetic binder system according to claim 5, wherein said plasticizer is at least one member selected from the group consisting of butanetriol trinitrate, trimethylolethane trinitrate, a mixture of bis-(2,2-dinitropropyl) formal, bis-(2,2-dinitrobutyl) formal and 2,2,8,8-tetranitro- 4,6-dioxadecane, triethylene glycol dinitrate and mixtures thereof.

7. An energetic binder system according to claim 1, wherein said plasticizer is non-energetic.

8. An energetic binder system according to claim 1 wherein said thermoplastic elastomer has A blocks and at least one B block, wherein said A blocks are crystalline at temperatures below about 60° C. and said B block(s) is amorphous at temperatures above about −20° C., said A blocks each being polyethers derived from monomers of oxetane and its derivatives and/or tetrahydrofuran and its derivatives.

9. An energetic binder system according to claim 1, wherein said thermoplastic elastomer comprises a non-cross linked polymer in which at least one pair of crystalline polyester A blocks flanking at least one amorphous polyester block.

10. An energetic binder system comprising:

33 wt. % to 90 wt. % of a thermoplastic elastomer which consists essentially of at least one segmented thermoplastic copolyester elastomer consisting essentially of a multiplicity of recurring intralinear long chain and short chain ester units connected head-to-tail through ester linkages;

5 to about 33½ wt. % of at least one plasticizer selected from the group consisting of dibutoxyethyl phthalate, dibutoxyethyl adipate, chlorinated paraffin, methyl abietate, methyl dihydro-abietate, N-ethyl-o and p-toluene sulfonamide, polypropylene glycol sebacate, dipropylene glycol dibenzoate, di(2-ethyl-hexyl) phthalate, 2-ethylhexyl-diphenyl phosphate, tri(2-ethylhexyl) phosphate, di(2-ethylhexyl) sebacate, santicizer 409 polyester, tetra-ethylene glycol-di(2-ethylhexoate), dibutoxyethoxyethyl adipate, N,N-dimethyl oleamide, dibutoxyethyl azelate, dioctyl azelate, dibutoxyethoxyethyl glutarate, dibutoxyethyl glutarate, polyethylene glycol 400 dilaurate, polyethylene glycol 400 dioleate, dibutoxyethoxyethyl sebacate, dibutoxyethyl sebacate, trioctyl trimellitate, butanetriol trinitrate, trimethylolethane trinitrate, a mixture of bis-(2,2-dinitropropyl) formal and bis-(2,2-dinitrobutyl) formal and 2,2,8,8-tetranitro-4,6-dioxadecane bis dinitropropyl formal, n-butyl-2-nitratoethyl-nitramine, ethyl-2-nitratoethyl-nitramine, eutectic blends of n-butyl-2-nitratoethyl-nitramine and methyl-2-nitratoethylnitramine, eutectic blends of ethyl-2-nitratoethyl-nitramine (42 wt. %) and methyl-2-nitratoethylnitramine (58 wt %), triethylene glycol dinitrate and mixtures thereof, and 5 to 33½ wt. % of nitrocellulose.

11. A thermoplastic elastomer-based low vulnerability ammunition gun propellant comprising (A) 60–85 wt. % of high-energy oxidizer dispersed in (B) an energetic binder which comprises 10–38 wt. % of thermoplastic elastomer, 1–13 wt. % of a plasticizer, and 1–13 wt. % of nitrocellulose.

12. A thermoplastic elastomer-based low vulnerability gun propellant according to claim 11, wherein said high-energy oxidizer is tetramethylenetetranitramine, trimethylenetrinitramine, or a mixtures thereof.

13. A thermoplastic elastomer-based low vulnerability gun propellant according to claim 11, wherein said thermoplastic elastomer has A blocks and at least one B block, wherein said A blocks are crystalline at temperatures below about 60° C. and said B block(s) is amorphous at temperatures above about −200° C., said A blocks each being polyethers derived from monomers of oxetane and its derivatives and/or tetrahydrofuran and its derivatives.

14. A thermoplastic elastomer-based low vulnerability gun propellant according to claim 11, wherein said thermoplastic elastomer comprises a non-cross linked polymer in which at least one pair of crystalline polyester A blocks flanking at least one amorphous polyester block.

15. A thermoplastic elastomer-based low vulnerability gun propellant according to claim 11, wherein said plasticizer is selected from the group consisting of dibutoxyethyl phthalate, dibutoxyethyl adipate, chlorinated paraffin, methyl abietate, methyl dihydro-abietate, N-ethyl-o and p-toluene sulfonamide, polypropylene glycol sebacate, dipropylene glycol dibenzoate, di(2-ethylhexyl) phthalate, 2-ethylhexyl-diphenyl phosphate, tri(2-ethylhexyl) phosphate, di(2-ethylhexyl) sebacate, santicizer 409 polyester, tetra-ethylene glycol-di(2-ethyl hexoate), dibutoxyethoxyethyl adipate, N,N-dimethyl oleamide, dibutoxyethyl azelate, dioctyl azelate, dibutoxyethoxyethyl glutarate, dibutoxyethyl glutarate, polyethylene glycol 400 dilaurate, polyethylene glycol 400 dioleate, dibutoxyethoxyethyl sebacate, dibutoxyethyl sebacate, trioctyl trimellitate, butanetriol trinitrate, trimethylol ethane trinitrate, a mixture of bis-(2,2-dinitropropyl) formal and bis-(2,2-dinitrobutyl) formal and 2,2,8,8-tetranitro-4,6-dioxadecane, n-butyl-2-nitratoethyl-nitramine, ethyl-2-nitratoethyl-nitramine, eutectic blends of n-butyl-2-nitratoethyl-nitramine and methyl-2-nitratoethylnitramine, eutectic blends of ethyl-2-nitratoethylnitramine (42 wt. %) and methyl-2-nitratoethylnitramine (58 wt %), triethylene glycol dinitrate and mixtures thereof.

16. A composite propellant comprising (A) an oxidizer selected from the group consisting of 75–80 wt. % ammonium nitrate, 80–85 wt. % ammonium perchlorate, and 75–85 wt. % of a mixture of ammonium nitrate and ammonium perchlorate, dispersed in (B) (1) an energetic binder system comprising at least one thermoplastic elastomer, at least one plasticizer and nitrocellulose, wherein said thermoplastic elastomer comprises 33–90 wt. % of said energetic binder system, and said thermoplastic elastomer has at least one block which is amorphous in the temperature range of about 250° C. to at least −20° C., and at least one block which is crystalline at in a temperature range of about 200° C. to about 25° C. and (2) an effective amount of powdered metal fuel.

17. A composite according to claim 16, wherein said composite includes a burn rate modifier.

18. A composite according to claim 16, wherein said powdered metal fuel is powdered aluminum.

19. A composite according to claim 16, wherein said plasticizer is selected from the group consisting of dibutoxyethyl phthalate, dibutoxyethyl adipate, chlorinated paraffin, methyl abietate, methyl dihydro-abietate, N-ethyl-o- and p-toluene sulfonamide, polypropylene glycol sebacate, dipropylene glycol dibenzoate, di(2-ethylhexyl) phthalate, 2-ethylhexyl-diphenyl phosphate, tri(2-ethyl-hexyl) phosphate, di(2-ethylhexyl) sebacate, santicizer 409 polyester, tetra-ethylene glycol-di(2-ethylhexoate), dibutoxyethoxyethyl adipate, N,N-dimethyl oleamide, dibutoxyethyl azelate, dioctyl azelate, dibutoxyethoxyethyl glutarate, dibutoxyethyl glutarate, polyethylene glycol 400 dilaurate, polyethylene glycol 400 dioleate, dibutoxyethoxyethyl sebacate, dibutoxyethyl sebacate, trioctyl trimellitate, butanetriol trinitrate, trimethylol ethane trinitrate, a mixture of bis-(2,2-dinitropropyl) formal and bis-(2,2-dinitrobutyl) formal and 2,2,8,8-tetranitro-4,6-dioxadecane, N-butyl-2-nitratoethylnitramine, ethyl-2-nitratoethyl-nitramine, eutectic blends of N-butyl-2-nitratoethyl-nitramine and methyl-2-nitratoethylnitramine, eutectic blends of ethyl-2-nitratoethylnitramine (42 wt. %) and methyl-2-nitratoethylnitramine (58 wt %), triethylene glycol dinitrate and mixtures thereof.

* * * * *